US009447561B2

(12) United States Patent
Nitti et al.

(10) Patent No.: US 9,447,561 B2
(45) Date of Patent: Sep. 20, 2016

(54) MACHINE BUCKET

(71) Applicant: Caterpillar Inc., Peoria, IL (US)

(72) Inventors: Julia Kay Nitti, Aurora, IL (US); Ryan Andrew Rochel, Metamora, IL (US); Jonathan David Stalnaker, Robinson, TX (US)

(73) Assignee: Caterpillar Inc., Peoria, IL (US)

( * ) Notice: Subject to any disclaimer, the term of this patent is extended or adjusted under 35 U.S.C. 154(b) by 124 days.

(21) Appl. No.: 14/213,499

(22) Filed: Mar. 14, 2014

(65) Prior Publication Data

US 2015/0259875 A1 Sep. 17, 2015

(51) Int. Cl.
*E02F 3/40* (2006.01)

(52) U.S. Cl.
CPC ..... *E02F 3/40* (2013.01)

(58) Field of Classification Search
CPC ..... E02F 3/40; E02F 3/401
USPC ..... 37/444
See application file for complete search history.

(56) References Cited

U.S. PATENT DOCUMENTS 2,989,198 A * 6/1961 Bradley ..... E02F 3/303 212/245
3,659,730 A * 5/1972 Butler ..... E02F 3/407 37/444
3,778,111 A * 12/1973 Ciofani ..... E02F 3/962 299/36.1
4,086,712 A * 5/1978 McReynolds ..... E02F 3/8152 37/444
4,187,050 A * 2/1980 Barbee ..... E02F 3/3622 172/272
4,230,435 A * 10/1980 Azevedo ..... E02F 5/025 37/408
4,309,142 A 1/1982 Shumaker
4,459,768 A * 7/1984 Albrecht ..... E02F 3/40 37/444
4,477,987 A * 10/1984 Stecklein ..... E02F 3/401 37/444
4,845,867 A * 7/1989 Albrecht ..... E02F 3/404 37/406

(Continued)

FOREIGN PATENT DOCUMENTS

WO WO 2012/113542 8/2012

*Primary Examiner* — Jamie L McGowan
(74) *Attorney, Agent, or Firm* — Finnegan, Henderson, Farabow, Garrett & Dunner, LLP

(57) ABSTRACT

A machine bucket may include a torque tube having an outer surface. The machine bucket may also include a support plate coupled to the torque tube. The support plate may include a bottom surface. The machine bucket may further include a base edge including a cutting edge. The machine bucket may also include a curved wrapper located between the support plate and the base edge. A ratio of a maximum distance between the curved wrapper and a first line extending from the base edge to the outer surface of the torque tube where the bottom surface of the support plate intersects the outer surface of the torque tube, taken substantially perpendicularly from the first line, relative to a length of the first line, may be about 0.61 to 0.63.

19 Claims, 4 Drawing Sheets

(56) References Cited

U.S. PATENT DOCUMENTS 5,815,959 A * 10/1998 Bahner ..... E02F 3/401 37/379
5,992,062 A * 11/1999 Evans ..... E02F 9/2833 37/444
6,581,308 B1 * 6/2003 Woerman ..... E02F 3/40 37/444
7,992,329 B2 * 8/2011 Horton ..... E02F 3/40 37/379
8,015,734 B1 * 9/2011 Mills ..... E02F 3/40 37/444
8,201,350 B2 * 6/2012 Folkerts ..... E02F 3/40 37/379
8,572,870 B2 11/2013 Kudo et al.
8,851,826 B2 * 10/2014 Nagata ..... E02F 3/40 414/722
2009/0282710 A1 * 11/2009 Johnson ..... E02F 3/3677 37/406
2011/0289803 A1 * 12/2011 Folkerts ..... E02F 9/2825 37/444
2013/0067779 A1 3/2013 Mills et al.
2013/0323000 A1 12/2013 Rochel et al.
2014/0237869 A1 * 8/2014 Caux ..... E02F 3/40 37/444

* cited by examiner

MACHINE BUCKET

TECHNICAL FIELD

The present disclosure is directed to a machine bucket, and more particularly, to a machine bucket having a shallow profile.

BACKGROUND

A machine, such as an excavator, may be equipped with a bucket to perform operations at a work site. Such operations may include, for example, penetrating material in the ground or in a pile to prepare building sites, loading material into trucks or onto conveyors, making cuts through hillsides, digging trenches, and cleaning ditches. The level of performance achieved by an operator using the excavator may depend, at least partially, on one or more parameters of the bucket. Using one particular bucket may provide a level of performance that significantly differs from the level achieved while performing similar operations using a different bucket that has one or more different parameters.

An exemplary machine bucket is disclosed in International Patent Application Publication No. WO 2012113542 to Raaz that published on Aug. 30, 2012 (the '542 publication). Specifically, the '542 publication describes a digging tool for excavators including a sloped, lower back region, a sloped, upper back region, and a concave, middle back region extending between the lower and upper back regions. To prevent material from sticking to inner surfaces of the tool, a radius of the middle back region of the tool increases continuously from the lower back region to the upper back region.

Although the digging tool of the '542 publication may be adequate for some applications, it may still be less than optimal. In particular, because the radius of the middle back region of the tool in the '542 publication increases from its lower back region to its upper back region, a deeper bucket profile is created, which may be less suitable for quick dumping applications. Also, having an increased radius at an upper region of the digging tool of the '542 publication may produce bulkiness and create visibility problems for the operator.

The machine bucket of the present disclosure solves one or more of the problems set forth above and/or other problems of the prior art.

SUMMARY

In one aspect, the present disclosure is directed to a machine bucket. The machine bucket may include a torque tube having an outer surface. The machine bucket may also include a support plate coupled to the torque tube. The support plate may include a bottom surface. The machine bucket may further include a base edge including a cutting edge. The machine bucket may also include a curved wrapper located between the support plate and the base edge. A ratio of a maximum distance between the curved wrapper and a first line extending from the base edge to the outer surface of the torque tube where the bottom surface of the support plate intersects the outer surface of the torque tube, taken substantially perpendicularly from the first line, relative to a length of the first line, may be about 0.61 to 0.63.

In another aspect, the present disclosure is directed to a machine bucket. The machine bucket may include a wrapper forming a portion of a receptacle for holding material. The wrapper may include a curved upper portion having a first radius of curvature, and a curved lower portion having a second radius of curvature that differs from the first radius of curvature. A ratio of the first radius of curvature to the second radius of curvature may be about 0.39 to 0.49.

In yet another aspect, the present disclosure is directed to a machine bucket. The machine bucket may include a top section. The top section may include a support plate, and a torque tube coupled to the support plate. The machine bucket may also include a bottom section including a base edge, and a middle section including a wrapper. The wrapper may extend between the torque tube and the base edge. The wrapper may include an upper portion coupled to the support plate, a lower portion coupled to the base edge, and a curved heel between the upper portion and the lower portion. An angle between the upper portion and the lower portion may be about 35°. Further, a ratio of a maximum distance between the wrapper and a first line extending from the base edge to the outer surface of the torque tube where the support plate intersects the torque tube, taken substantially perpendicularly from the first line, relative to a length of the first line, may be about 0.61 to 0.63.

DETAILED DESCRIPTION

FIGS. 1-4 illustrate an exemplary disclosed bucket 10. Bucket 10 may be a component of a machine (not shown). The machine may embody a mobile machine, such as an excavator or any other machine, that may perform operations associated with an industry, including, for example, mining, construction, farming, or transportation. The machine may include a linkage assembly (not shown) coupled to bucket 10, including one or more supporting members and actuators for moving bucket 10 to perform operations, including engaging, scooping, lifting, transporting, lowering, and dumping material.

Figure 1:
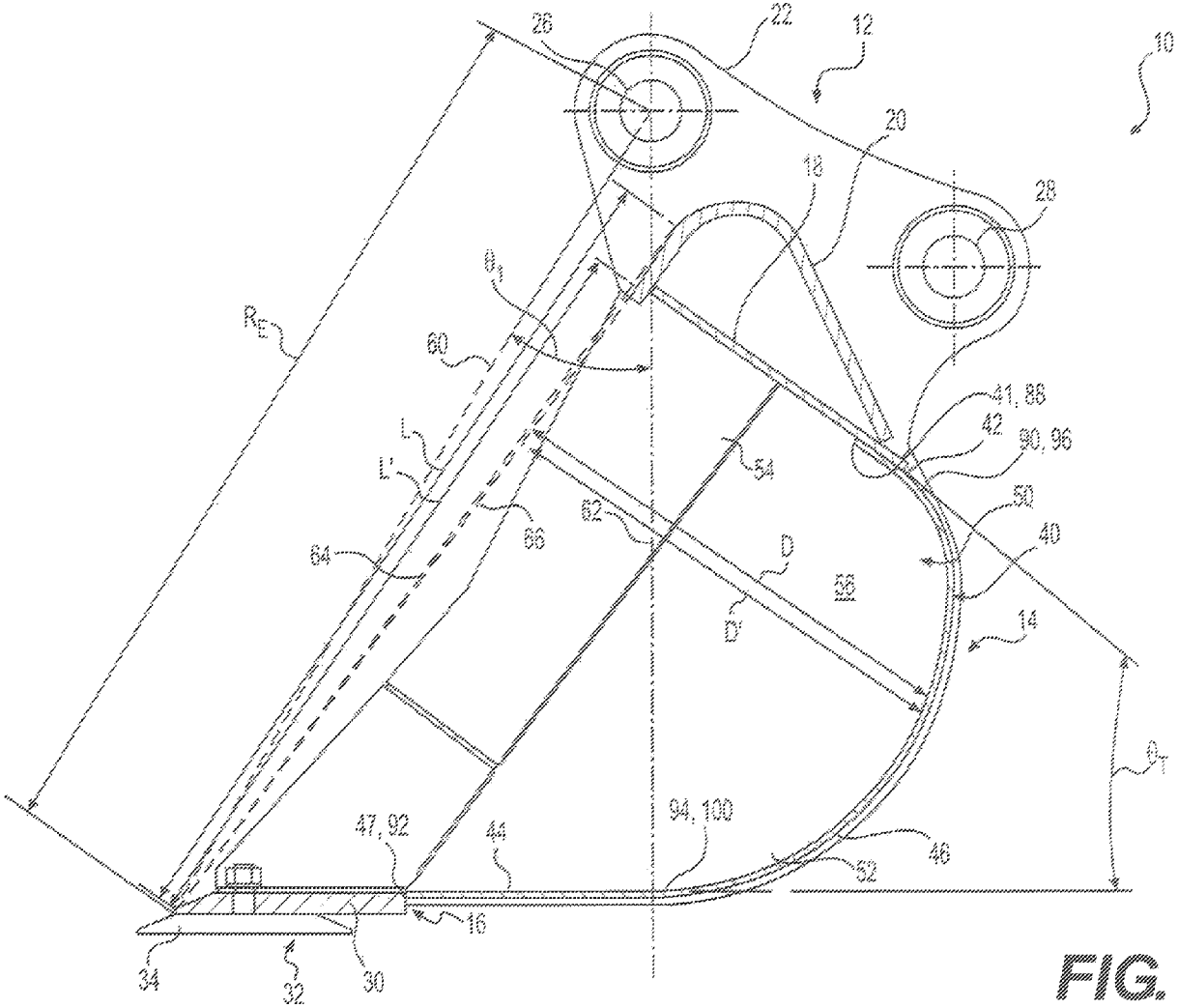
FIG. 1 is a cross-sectional side view illustration of an exemplary disclosed bucket.
Figure 3:
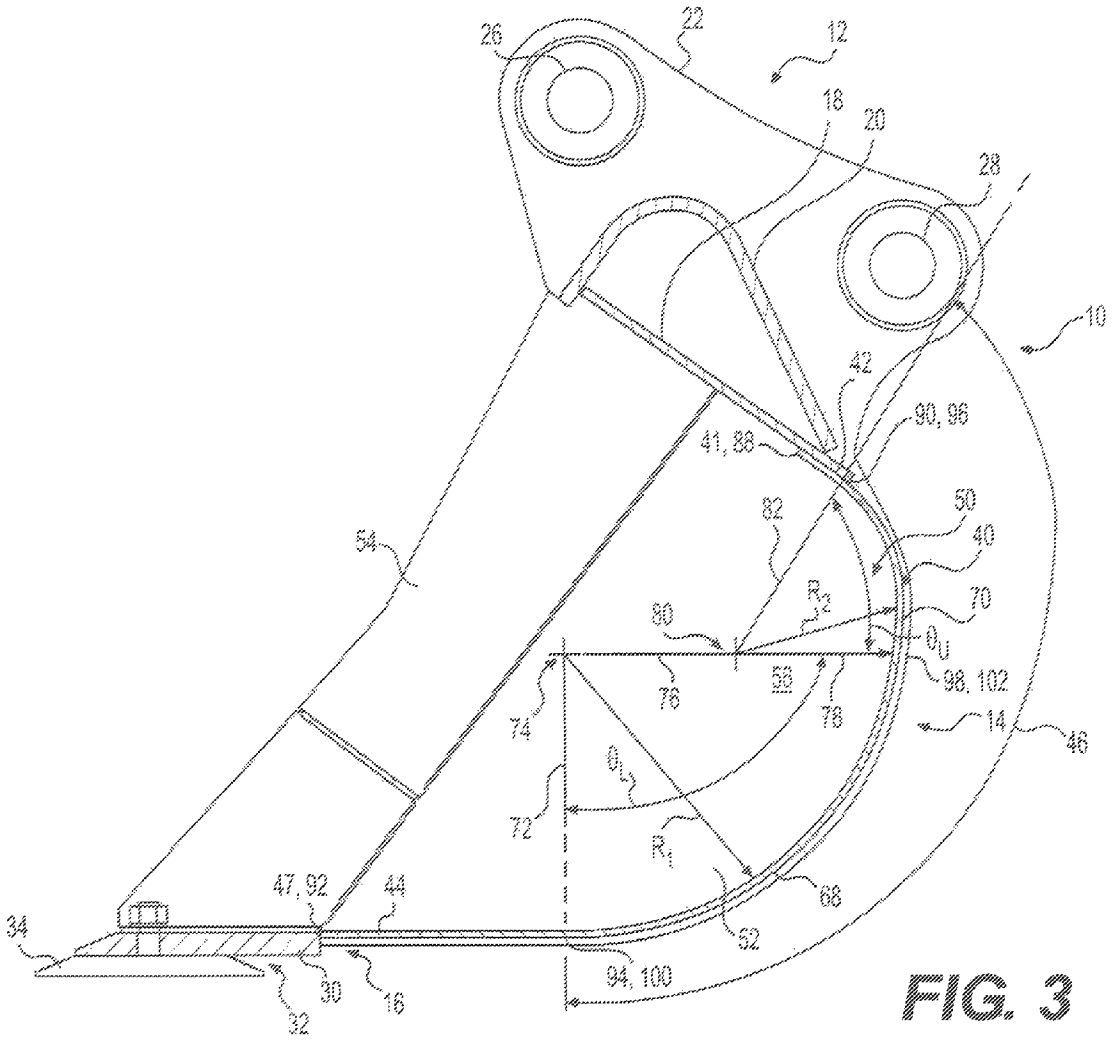
FIG. 3 is another cross-sectional side view illustration of the bucket of FIG. 1.
Figure 4:
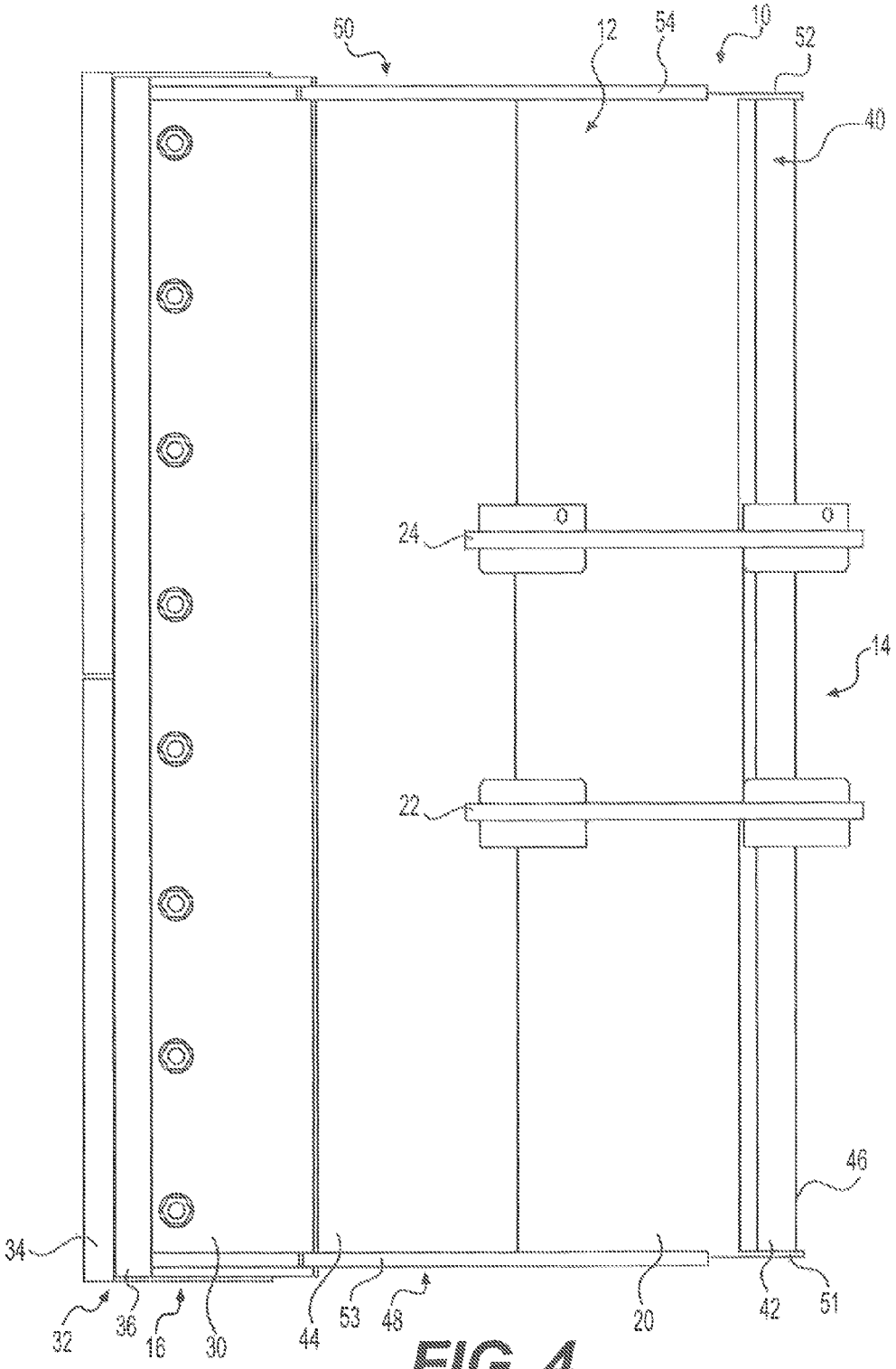
FIG. 4 is a top view illustration of the bucket of FIG. 1.

As shown in FIGS. 1, 3, and 4, bucket 10 may include a top section 12, a middle section 14, and a bottom section 16. Top section 12 may include a support plate 18 and a torque tube 20 coupled to support plate 18. For example, a first end of torque tube 20 may be welded to a first end of support plate 18, and a second end of torque tube 20 may be welded to a top surface of a second end of support plate 18. A first hinge plate 22 may be coupled to support plate 18 and torque tube 20, and a second hinge plate 24 (shown only in FIG. 4), similar to first hinge plate 22, may be coupled to support plate 18 and torque tube 20. First hinge plate 22 may include an upper pin bore 26 and a lower pin bore 28, configured to receive first and second pins of the linkage assembly of the machine, thereby operatively coupling bucket 10 to the machine. Second hinge plate 24 may include similar upper and lower pin bores (not shown).

Middle section 14 may include a wrapper 40 having a first end 41, a substantially flat upper portion 42 coupled to support plate 18, a substantially flat lower portion 44, a second end 47, and a curved heel 46 extending between the upper and lower portions 42 and 44. Lower portion 44 may be coupled to a base edge 30 of bottom section 16. For example, base edge 30 may be welded to second end 47 of wrapper 40. Base edge 30 may be configured to engage and penetrate material. Bottom section 16 may also include one or more ground engaging tools 32. Ground engaging tools 32 may be coupled to base edge 30, and each ground engaging tool 32 may include, for example, at least one cutting edge 34. It is contemplated that, in other embodiments, ground engaging tool 32 may include shrouds, teeth (adapters), top covers, half arrow segments, or any other tools, if desired.

Bucket 10 may also include a first side 48 (shown in FIG. 4, but removed from FIGS. 1-3 to illustrate interior features of bucket 10) and a second side 50. First side 48 may be coupled to a first edge of support plate 18, torque tube 20, wrapper 40, and base edge 30, while second side 50 may be coupled to a second edge of support plate 18, torque tube 20, wrapper 40, and base edge 30. The second edge may be located opposite the first edge. As shown in FIGS. 1, 3, and 4, second side 50 may include a side plate 52 and a side bar 54. First side 48 may also include a side plate 51 and a side bar 53 similar to side plate 52 and side bar 54 of second side 50. Support plate 18, wrapper 40, base edge 30, first side 48, and second side 50, together, may define a receptacle 56 configured to receive material.

Figure 2:
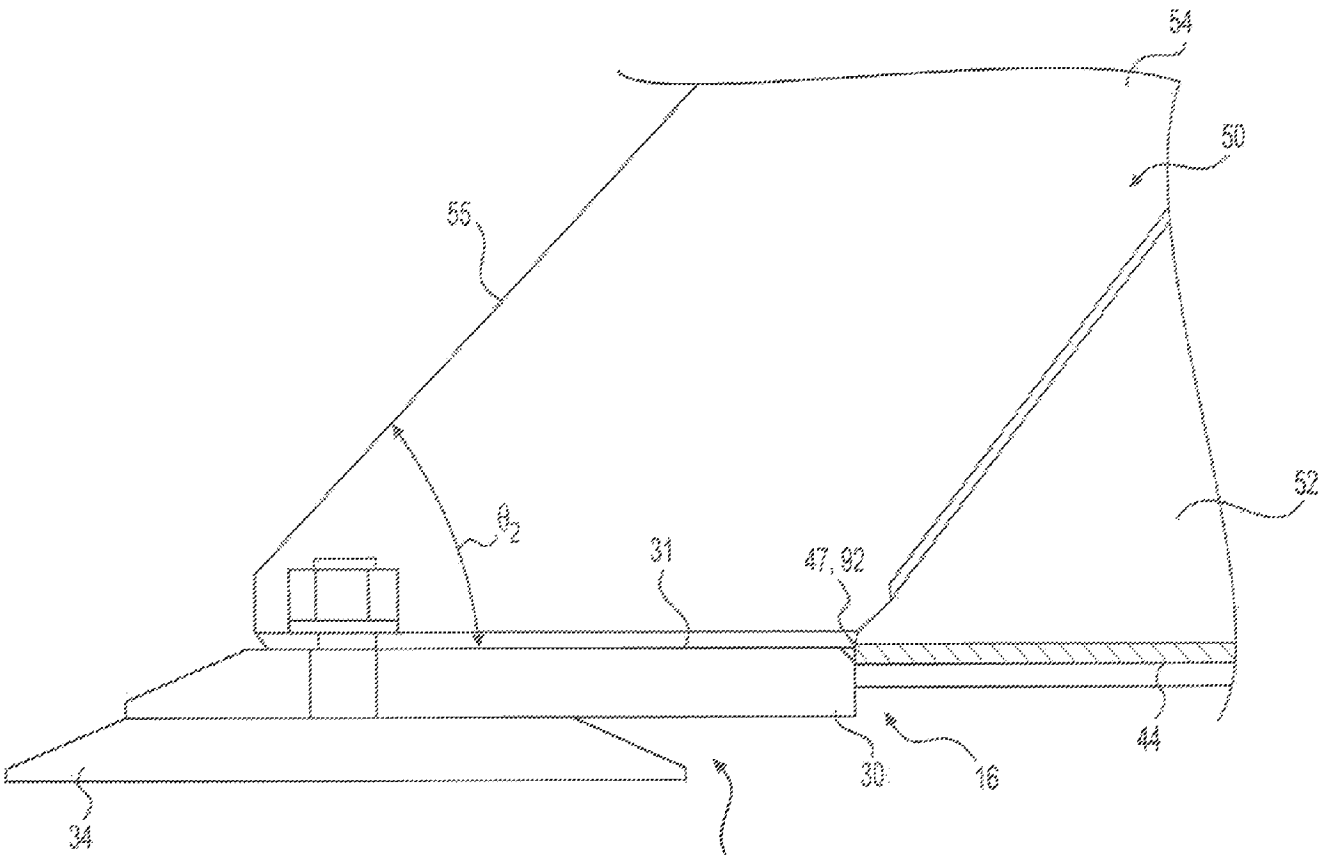
FIG. 2 is an enlarged side view illustration of a portion of the bucket of FIG. 1.

A number of bucket parameters are identified in FIGS. 1-3. These bucket parameters may include, for example, an edge radius $R_E$, an edge forward angle $\theta_1$, a depth D, a depth D', a length L, a length L', a lower wrapper radius $R_1$, an upper wrapper radius $R_2$, an upper radius angle $\theta_U$, a lower radius angle $\theta_L$, a hinge support plate angle $\theta_T$, and a side bar angle $\theta_2$.

As shown in FIG. 1, edge radius $R_E$ may be a distance between a center of upper pin bore 26 and an edge of bottom section 16. The edge of bottom section 16 may include a point on base edge 30 farthest away from upper pin bore 26.

Edge forward angle $\theta_1$ may be an angle formed between an edge forward line 60 and a line 62. Edge forward line 60 may extend from a center of upper pin bore 26 to the edge of bottom section 16, such as the forward most point of base edge 30. Line 62 may extend substantially perpendicularly from lower portion 44 of wrapper 40 and through the center of upper pin bore 26. It should be noted that the term "plane" may be substituted for the term "line" with respect to any of the lines used to define the parameters of bucket 10.

A first throat line 64 may extend between a forward most point of base edge 30 and an outer surface of torque tube 20. The position of first throat line 64 may be found by drawing a line that extends from the forward most point of base edge 30 to torque tube 20, the line being generally tangential to an outer surface of torque tube 20 and terminating at the tangent point. Length L may be a length of first throat line 64. Depth D may be a length of the longest line extending generally perpendicularly from first throat line 64 to wrapper 40.

A second throat line 66 may extend between the forward most point of base edge 30 and a portion of torque tube 20. This portion of torque tube 20 may be a point at which a line defining a lower surface of support plate 18 intersects an outer surface of torque tube 20. Length L' may be a length of second throat line 66. Depth D' may be a length of the longest line extending generally perpendicularly from second throat line 66 to wrapper 40.

As shown in FIG. 3, a lower portion 68 of curved heel 46 may extend between lower portion 44 of wrapper 40 and an upper portion 70 of curved heel 46. Lower portion 68 may approximate a portion of a circle having a radius $R_1$ (referred to herein as lower wrapper radius $R_1$). Upper portion 70 may extend between lower portion 68 and upper portion 42 of wrapper 40. Upper portion 70 may approximate a portion of a circle having a radius $R_2$ (referred to herein as upper wrapper radius $R_2$). Lower radius angle $\theta_L$ may be the angle between a line 72 (extending from a center 74 of the portion of the circle defined by lower portion 68 to an end 100 of lower portion 68) and a line 76 (extending from center 74 to an end 102 of lower portion 68). In other words, lower radius angle $\theta_L$ may be a central angle of the are defined by lower portion 68. Upper radius angle $\theta_U$ may be the angle between a line 78 (extending from a center 80 of the portion of the circle defined by upper portion 70 and an end 98 of upper portion 70) and a line 82 (extending from center 80 to an end 96 of where upper portion 70). In other words, upper radius angle $\theta_U$ may be a central angle of the arc defined by upper portion 70.

A first end 88 of upper portion 42 may coincide with first end 41 of wrapper 40. A second end 90 of upper portion 42 may coincide with first end 96 of upper portion 70. Second end 90 of upper portion 42 (and first end 96 of upper portion 70) may be located at a point along wrapper 40 where wrapper 40 begins to have substantial curvature when moving from first end 41 to second end 47 of wrapper 40. It should be understood that upper portion 42 may be slightly curved and/or have one or more slightly curved regions. These curved regions may have greater curvature than the entirely flat region, but less curvature than any region of curved heel 46. As a result, these curved regions may provide a smooth transition from upper portion 42 to curved heel 46. For example, upper portion 42 may include a slightly curved region proximate its second end 90 where upper portion 42 transitions into upper portion 70. In this region, the radius of curvature of upper portion 42 may decrease when moving toward upper portion 70.

A first end 92 of lower portion 44 may generally coincide with second end 47 of wrapper 40. A second end 94 of lower portion 44 may coincide with first end 100 of lower portion 68. Second end 94 of lower portion 44 (and first end 100 of lower portion 68) may be located at a point along wrapper 40 where wrapper 40 begins to have substantial curvature when moving from second end 47 to first end 41 of wrapper 40. It should be understood that lower portion 44 may be slightly curved and/or have one or more slightly curved regions. These curved regions may have greater curvature than the entirely flat region, but less curvature than any region of curved heel 46. As a result, these curved regions may provide a smooth transition from curved heel 46 to lower portion 44. For example, lower portion 44 may include a slightly curved region proximate its second end 94 where lower portion 44 transitions into lower portion 68. In this region, the radius of curvature of lower portion 44 may decrease when moving toward lower portion 68.

Second ends 98 and 102 of upper portion 70 and lower portion 68 may generally coincide. Upper portion 70 may have a radius of curvature approximating upper wrapper radius $R_2$. Lower portion 68 may have a radius of curvature approximating lower wrapper radius $R_1$. First end 96 of upper portion 70 may be located at the first point on wrapper 40 where wrapper 40 has the radius of curvature approximating upper wrapper radius $R_2$, when moving from first end 41 to second end 47 of wrapper 40. First end 100 of lower portion 68 may be located at the first point on wrapper 40 where wrapper 40 has the radius of curvature approximating lower wrapper radius $R_1$, when moving from second end 47 to first end 41 of wrapper 40. Second end 98 of upper portion 70 (and second end 102 of lower portion 68) may be located at the point on wrapper 40 where the radius of curvature of wrapper 40 changes from approximating upper wrapper radius $R_2$ to approximating lower wrapper radius $R_1$.

It should be understood that the radius of curvature of upper portion 70 and/or lower portion 68 may vary slightly. For example, the radius of curvature of upper portion 70 may be a first value in one region of upper portion 70, and a second value, that is slightly different from the first value in another region of upper portion 70. Similarly, it is also contemplated that the radius of curvature of lower portion 68 may have a first value in one region of lower portion 68, and a second value that is slightly different from the first value in another region of lower portion 68. For example, upper portion 70 may include a transition region proximate its second end 98, where upper portion 70 transitions into lower portion 68, and lower portion 68 may include a transition region proximate its second end 102 where lower portion 68 transitions into upper portion 70. In the transition region of upper portion 70, the radius of curvature of upper portion 70 may increase in the direction of lower portion 68. In the transition region of lower portion 68, the radius of curvature of lower portion 68 may decrease in the direction of upper portion 70.

Referring to FIG. 1, hinge support plate angle $\theta_T$ may be an angle between a top surface of base edge 30 and a bottom surface of support plate 18. Additionally or alternatively, hinge support plate angle $\theta_T$ may be an angle between substantially straight upper and lower portions 42 and 44 of wrapper 40.

Side bar angle $\theta_2$ is shown in FIG. 2. Side bar angle $\theta_2$ may be an angle between a top surface 31 of base edge 30 and a lower edge portion 55 of side bar 54.

In a first example, bucket 10 may have an edge radius $R_E$ of approximately 1,020 mm, an edge forward angle $\theta_1$ of approximately 31°, a depth D of approximately 541 mm, a length L of approximately 949 mm, a ratio of D/L of approximately 0.570, a depth D' of approximately 532 mm, a length L' of approximately 860 mm, a ratio of D'/L' of approximately 0.618, a lower wrapper radius $R_1$ of approximately 325 mm, an upper wrapper radius $R_2$ of approximately 150 mm, a radius ratio of $R_2/R_1$ of approximately 0.46, an upper radius angle $\theta_U$ of approximately 49°, a lower radius angle $\theta_L$ of approximately 96°, a hinge support plate angle $\theta_T$ of approximately 35°, and a side bar angle $\theta_2$ of approximately 48°.

In a second example, bucket 10 may have an edge radius $R_E$ of approximately 1,190 mm, an edge forward angle $\theta_1$ of approximately 31°, a depth D of approximately 611 mm, a length L of approximately 1,077 mm, a ratio of D/L of approximately 0.567, a depth D' of approximately 601 mm, a length L' of approximately 961 mm, a ratio of D'/L' of approximately 0.625, a lower wrapper radius $R_1$ of approximately 380 mm, an upper wrapper radius $R_2$ of approximately 150 mm, a radius ratio of $R_2/R_1$ of approximately 0.39, an upper radius angle $\theta_U$ of approximately 51°, a lower radius angle $\theta_L$ of approximately 94°, a hinge support plate angle $\theta_T$ of approximately 35°, and a side bar angle $\theta_2$ of approximately 48°.

In a third example, bucket 10 may have an edge radius $R_E$ of approximately 1,214 mm, an edge forward angle $\theta_1$ of approximately 31°, a depth D of approximately 637 mm, a length L of approximately 1,130 mm, a ratio of D/L of approximately 0.564, a depth D' of approximately 626 mm, a length L' of approximately 1,012 mm, a ratio of D'/L' of approximately 0.618, a lower wrapper radius $R_1$ of approximately 390 mm, an upper wrapper radius $R_2$ of approximately 190 mm, a radius ratio of $R_2/R_1$ of approximately 0.49, an upper radius angle $\theta_U$ of approximately 53°, a lower radius angle $\theta_L$ of approximately 92°, a hinge support plate angle $\theta_T$ of approximately 35°, and a side bar angle $\theta_2$ of approximately 48°.

As will be described in more detail below, examples of bucket 10 described above may possess performance enhancing geometries. Differences between the examples demonstrate that some variability of the values for bucket parameters is contemplated. For example, values may vary depending on the desired overall size of bucket 10, and/or parameters associated with the linkage assembly used to coupled bucket 10 to a machine.

INDUSTRIAL APPLICABILITY

The performance enhancing characteristics of a bucket 10 may come as a result of the values of its parameters. For example, the disclosed ratio of D'/L' may be about 0.61 to 0.63. This ratio may provide a shallow profile of bucket 10, thereby improving the ease by which material exits from bucket 10. In addition, this ratio may help to prevent material from sticking to surfaces of bucket 10.

If a bucket has a ratio of D'/L' that exceeds the desired range, material may stick to surfaces of the bucket, thus reducing a volume of the bucket in subsequent earth moving operations. In addition, a bucket that has a ratio of D'/L' that exceeds the desired range may make the bucket more difficult to load and unload. Further, if the ratio of D'/L'exceeds the desired range, the material entering into the bucket must travel across a greater distance before reaching the back of the bucket during filling, and must also travel back across that greater distance during dumping. The added travel time for material entering into and exiting out of the bucket may increase cycle times.

If a bucket has a value for the ratio of D'/L' that falls below the desired range, the bucket may be loaded and unloaded too quickly, and be lacking in terms of capacity. For example, less material may be dumped and loaded for each pass with the bucket. By keeping the value for the ratio of D'/L' in desired range of 0.61 and 0.63, a balance between ease of loading and dumping and bucket capacity may exist for bucket 10, thus helping to avoid the inefficiencies described above.

The disclosed radius ratio of $R_2/R_1$ may be about 0.39 to 0.49. This ratio may help to ensure that bucket 10 has a shape with the above-described shallow profile that improves the ease of dumping and filling of bucket 10, and helps to prevent material from sticking to inner surfaces of bucket 10.

The disclosed edge forward angle value $\theta_1$ may be about 31°. This edge forward angle $\theta_1$ value may provide a machine operator with line of sight to a forward most point of a bottom section 16 of bucket 10, such as a forward most point of base edge 30 of bucket 10. As the machine operator moves material with bucket 10, this line of sight may provide the machine operator with the ability to move and place bucket 10 accurately. Thus, unnecessary bucket movements may be avoided. Accordingly, operations may be performed more quickly, and the amount of material moved per unit of fuel may be increased, producing cost savings.

Further, the disclosed edge forward angle $\theta_1$ may provide the machine operator with line of sight into at least a portion of a receptacle 56 of bucket 10. This may provide the machine operator with the ability to visually determine, during filling, whether bucket 10 is fully filled with material or has additional capacity for material. Thus, the machine operator may avoid wasting time trying to fill a full bucket with additional material or performing operations with only partially filled buckets.

The disclosed hinge support plate angle $\theta_T$ may be about 35°. This hinge support plate angle $\theta_T$ may have an effect on its capacity. If a bucket's hinge support plate angle $\theta_T$ is smaller than the disclosed values, the bucket's capacity may be too large, which can increase cycle times with added travel time for material entering into and exiting out of the bucket. If a bucket's hinge support plate angle $\theta_T$ is larger than the disclosed values, the bucket's hinge strength may be affected, thus reducing the amount of material that can be loaded into the bucket.

The disclosed side bar angle $\theta_2$ may be about 48°. Providing a side bar angle $\theta_2$ at about 48° may help enhance visibility to the machine operator, while ensuring the ability of bucket 10 to penetrate material. For example, if the side bar angle $\theta_2$ is too small, the bucket may not be able to sufficiently penetrate the material. On the other hand, if the side bar angle $\theta_2$ is too large, it may impair the operator's visibility, which may hurt efficiency.

It will be apparent to those skilled in the art that various modifications and variations can be made in the disclosed buckets without departing from the scope of the disclosure. Additionally, other embodiments of the disclosed buckets will be apparent to those skilled in the art from consideration of the specification. It is intended that the specification and examples be considered as exemplary only, with a true scope of the disclosure being indicated by the following claims and their equivalents.

What is claimed is:

1. A machine bucket, comprising:
- a torque tube having an outer surface;
- a support plate coupled to the torque tube, the support plate including a bottom surface;
- a base edge including a cutting edge; and
- a curved wrapper located between the support plate and the base edge,
- wherein a ratio of a maximum distance between the curved wrapper and a first line extending from the base edge to the outer surface of the torque tube where the bottom surface of the support plate intersects the outer surface of the torque tube, taken substantially perpendicularly from the first line, relative to a length of the first line, is 0.61 to 0.63.

2. The machine bucket of claim 1, wherein the curved wrapper includes an upper portion and a lower portion, and the maximum distance extends from the first line to the upper portion of the wrapper.

3. The machine bucket of claim 2, wherein the upper portion defines an arc having a central angle of 49° to 53°.

4. The machine bucket of claim 2, wherein the lower portion defines an arc having a central angle of 92° to 96°.

5. The machine bucket of claim 2, wherein the wrapper includes a substantially flat upper portion and a substantially flat lower portion, and an angle between the substantially flat upper and lower portions is 35°.

6. The machine bucket of claim 5, further including a hinge plate coupled to the outer surface of the torque tube, the hinge plate having an upper pin bore and a lower pin bore.

7. The machine bucket of claim 6, wherein an angle formed between a second line extending from a forward most point of the base edge to a center of the upper pin bore, and a third line extending substantially perpendicularly from the lower portion of the wrapper to the center of the upper pin bore, is 31°.

8. The machine bucket of claim 2, further including a side bar and a side plate, the side bar having an edge, wherein an angle formed between a top surface of the base edge and at least a portion of the edge of the side bar is 48°.

9. The machine bucket of claim 2, wherein a ratio of a radius of curvature of the upper portion relative to a radius of curvature of the lower portion is 0.39 to 0.49.

10. A machine bucket, comprising:
- a wrapper forming a portion of a receptacle for holding material, the wrapper including:
  - a curved upper portion having a first radius of curvature; and
  - a curved lower portion having a second radius of curvature that differs from the first radius of curvature,
- wherein a ratio of the first radius of curvature to the second radius of curvature is 0.39 to 0.49, and wherein:
- the curved upper portion defines an arc having a central angle of 49° to 53°, and
- the curved lower portion defines an arc having a central angle of 92° to 96°.

11. The machine bucket of claim 10, further including:
- a support plate coupled to a first end of the wrapper, the support plate including a bottom surface;
- a torque tube coupled to a top surface of the support plate; and
- a base edge coupled to a second end of the wrapper.

12. The machine bucket of claim 11, wherein an angle between the first end of the wrapper and the second end of the wrapper is 35°.

13. The machine bucket of claim 11, further including:
- a hinge plate coupled to the torque tube, the hinge plate including an upper pin bore and a lower pin bore; and
- a ground engaging tool coupled to the base edge, the ground engaging tool having a cutting edge;
- wherein a first line extends from the base edge to a center of the upper pin bore, a second line extends substantially perpendicularly from the wrapper to the center of the upper pin bore, and an angle between the first and second lines is 31°.

14. The machine bucket of claim 11, further including a side section including a side plate and a side bar, the side bar including an edge, wherein an angle between a top surface of the base edge and the edge of the side bar is 48°.

15. The machine bucket of claim 11, wherein a line extends from a forward most point of the base edge to an outer surface of the torque tube, and a ratio of a maximum distance between the line and the wrapper, taken perpendicularly from the line to the wrapper, relative to a length of the line has a value of 0.61 to 0.63.

16. A machine bucket, comprising:
- a top section including a support plate and a torque tube coupled to the support plate;
- a bottom section including a base edge; and a middle section including a wrapper, the wrapper extending between the torque tube and the base edge, wherein the wrapper includes:
  - an upper portion coupled to the support plate;
  - a lower portion coupled to the base edge; and
  - a curved heel between the upper portion and the lower portion, an angle between the upper portion and the lower portion being 35°, and wherein:
  - a ratio of a maximum distance between the wrapper and a first line extending from the base edge to the torque tube where the support plate intersects the torque tube, taken substantially perpendicularly from the first line, relative to a length of the first line, is 0.61 to 0.63.

17. The machine bucket of claim 16, wherein an angle formed between a second line extending from the base edge to a center of an upper pin bore, and a third line extending substantially perpendicularly from the lower portion of the wrapper to the center of the upper pin bore, has a value of 31°.

18. The machine bucket of claim 16, further including a side bar and a side plate, the side bar including an edge, wherein an angle formed between a top surface of the base edge and at least a portion of the edge of the side bar has a value of 48°.

19. The machine bucket of claim 16, wherein a ratio of a radius of curvature of the upper portion relative to a radius of curvature of the lower portion is 0.39 to 0.49.

* * * * *